US006698492B2

(12) United States Patent
Lewis, Jr.

(10) Patent No.: US 6,698,492 B2
(45) Date of Patent: Mar. 2, 2004

(54) HINGE GUARD FOR OVERHEAD DOOR

(75) Inventor: Richard J. Lewis, Jr., Loveland, OH (US)

(73) Assignee: Clopay Building Products R&D Company, Inc., Cincinnati, OH (US)

( * ) Notice: Subject to any disclaimer, the term of this patent is extended or adjusted under 35 U.S.C. 154(b) by 0 days.

(21) Appl. No.: 10/194,770

(22) Filed: Jul. 12, 2002

(65) Prior Publication Data

US 2004/0007334 A1 Jan. 15, 2004

(51) Int. Cl.[7] ..... E05D 15/10
(52) U.S. Cl. ..... 160/201; 160/40; 49/383
(58) Field of Search ..... 160/201, 229.1, 160/207, 40, 405; 49/383; 16/DIG. 1

(56) References Cited

U.S. PATENT DOCUMENTS

| | | | | |
|---|---|---|---|---|
| 2,233,351 A | | 2/1941 | Rowe | |
| 2,494,001 A | | 1/1950 | Rowe | |
| 2,504,635 A | | 4/1950 | Bradley | |
| 2,557,716 A | | 6/1951 | Allee | |
| 2,694,234 A | * | 11/1954 | Roby et al. | 49/383 |
| 2,786,523 A | | 3/1957 | Phillips | |
| 2,932,056 A | | 4/1960 | Crosswell | |
| 2,952,313 A | | 9/1960 | Stroup | |
| 2,995,785 A | * | 8/1961 | Hallenbeck | 49/383 |
| 3,302,690 A | * | 2/1967 | Hurd | 160/40 |
| 3,319,697 A | | 5/1967 | Krohn | |
| 3,376,913 A | | 4/1968 | Clapsaddle | |
| 3,846,868 A | | 11/1974 | Brydolf | |
| 3,941,180 A | * | 3/1976 | Thill | 160/201 X |
| 4,315,345 A | | 2/1982 | Schijf | |
| 4,344,253 A | * | 8/1982 | Stiles | 49/383 |
| 5,001,862 A | | 3/1991 | Albenda | |
| 5,002,114 A | | 3/1991 | Hörmann | |
| 5,235,724 A | | 8/1993 | Perrin et al. | |
| 5,362,131 A | | 11/1994 | Susko et al. | |
| 5,566,740 A | | 10/1996 | Mullet et al. | |
| 5,884,363 A | | 3/1999 | Tofts | |
| 5,913,352 A | | 6/1999 | Scates et al. | |
| 5,927,369 A | | 7/1999 | Pedersen | |
| 5,934,352 A | | 8/1999 | Morgan | |
| 6,006,817 A | | 12/1999 | Stone et al. | |
| 6,098,697 A | | 8/2000 | Krupke et al. | |
| 6,134,839 A | * | 10/2000 | Johansson | 49/383 |
| 6,158,550 A | | 12/2000 | Arnoldy | |
| 6,527,036 B1 | * | 3/2003 | Welsh | 160/201 |

FOREIGN PATENT DOCUMENTS

| | | |
|---|---|---|
| EP | 0370324 | 5/1990 |
| EP | 0394691 | 10/1990 |
| GB | 2022178 | 12/1979 |

* cited by examiner

*Primary Examiner*—David Purol
(74) *Attorney, Agent, or Firm*—Wood, Herron & Evans, LLP

(57) ABSTRACT

An overhead door and associated mating panels include a hinge guard which is used in conjunction with each of the hinges of a multi-panel or sectional door. The hinge guard includes a base that is screwed, bolted or otherwise secured to a lower one of the door panels or a stile on the lower panel. The base is designed and configured to fit between the spaced hinge arms of an upper hinge leaf of the door. The hinge guard also includes a pair of protective side flanges that are connected by a bridge to a common edge of the base. Each flange extends generally parallel to a respective side of the base and is spaced from the side to provide a gap through which one of the hinge arms of the upper hinge leaf pivots. The protective flanges are positioned on the outboard or external side of the hinge arms to thereby block or inhibit foreign objects from interfering with the movement of the hinge arms during articulation of the hinge. The hinge guard inhibits the insertion of a foreign object into the hinge from the side. Secondly, the raised arcuate-molded contour of a boss on the base minimizes the space or clearance between the upper hinge leaf and the lower door panel during articulation of the hinge to thereby inhibit the insertion of foreign matter in this region of the hinge.

40 Claims, 2 Drawing Sheets

HINGE GUARD FOR OVERHEAD DOOR

BACKGROUND OF THE INVENTION

This invention relates to overhead doors and, more particularly, to guard for the hinge assemblies on an overhead.

There are numerous designs of overhead or retractable door assemblies which are commonly used for garage doors, truck doors, warehouse doors or the like. Typically, an overhead door of this type is convertible between an open, overhead or generally horizontal configuration and a closed generally vertically oriented configuration in which the door closes an opening in the building or the like. The overhead door is typically movable along a track assembly mounted proximate the opening and the track assembly commonly includes a generally vertical track section, a generally horizontal track section and a curved transition track section joining the horizontal and vertical sections together.

Retractable overhead doors of this type are conventionally constructed of a number of vertically arranged, horizontally oriented panels which can fold along the horizontal divisions between the panels to enable the door to pass along the curved transition section of the track when being opened or closed. The panels are pivotally coupled together with hinges on the interior surface or back face of the door panels. Commonly, gaps appear between the adjacent panels while the panels are traveling toward and/or through the curved transition section of the track. Additionally, the hinges articulate during pivotal movement of the panels and gaps or spaces relative to the hinge assembly change, close and/or constrict. Foreign objects could be inserted into these gaps by accident or due to improper handling of the door which could result in damage to the door and/or the obstructing object.

Recently, many different overhead door designs have been suggested which are aimed at addressing this situation. These types of door designs often include complicated structures which cover the gaps between the articulating panels or involved and complicated panel geometries to minimize or inhibit the insertion of a probe or other foreign object between the adjacent articulating panels. One beneficial design to minimize the gaps between adjacent panels is disclosed in U.S. Pat. No. 6,006,817, assigned to the assignee of this invention and hereby incorporated by reference in its entirety.

Nevertheless, while the gaps between the adjacent door panels have been addressed by the invention in the above-identified patent, the gaps relative to the hinges and adjacent components may still provide an opportunity for the insertion of foreign objects which could lead to damage to the door, hinge components and/or the obstructing object.

Therefore, there is a need in the industry for an improved overhead door and associated panels and hinge assemblies which minimizes the opportunity for the insertion of foreign objects and the resulting damage relative to the hinge assemblies and associated components.

SUMMARY OF THE INVENTION

Presently preferred embodiments of this invention offer these and other advantages over known overhead door, panel and hinge designs. In one embodiment, this invention includes a number of horizontally oriented panels vertically stacked one upon the other in edge-to-edge relationship.

The panels are coupled to a track assembly mounted proximate the garage, warehouse, truck or other opening.

The track assembly includes a generally vertical section, a generally horizontal section and a curved transition section joining the horizontal and vertical sections together. Rollers are mounted on the panels and coupled to the track assembly to guide the door between a closed generally vertical configuration with the upper and lower edges of the adjacent panels mated together and an open generally horizontal configuration extending generally parallel to the ceiling of the garage or the like.

One aspect of this invention includes a hinge guard which is to be used in conjunction with each of the hinges of a multi-panel or sectional garage door. The hinge guard in one embodiment is constructed of molded polypropylene and can be used as a accessory or add-on feature to the hinge of the door or as original equipment for the door.

The hinge guard of this invention includes a base that is screwed, bolted or otherwise secured to a lower one of the door panels or a stile on the lower panel. The hinge guard in one embodiment is secured with a screw or other bolt extending through a central aperture in the base. The base is generally rectangular and has a generally flat or planar lower surface and a smoothly rounded boss is formed on the upper surface. The base is designed and configured to fit between the spaced hinge arms of an upper hinge leaf of the hinge design.

The hinge guard also includes a pair of protective side flanges that are each connected by a bridge to a common edge of the base. Each flange extends generally parallel to a respective side of the base and is spaced from the side to provide a gap through which one of the hinge arms of the upper hinge leaf pivots. The protective flanges are positioned on the outboard or external side of the hinge arms to thereby block or inhibit a foreign object from interfering with the movement of the hinge arms during articulation of the hinge.

In one embodiment of the hinge guard that is specifically designed for an intermediate hinge on the door, each protective flange has a smoothly continuous contour; whereas, in an alternative embodiment of the hinge guard specifically designed for use with a hinge that incorporates a roller tube, the protective flanges include a step to accommodate positioning of the roller tube mounted on the hinge leaf.

The hinge guard design provides principally two features to inhibit interference with the articulation of the hinge. Firstly, the protective outboard flanges inhibit the insertion of a foreign object into the hinge from the side. Secondly, the raised arcuate-molded contour of the boss minimizes the space or clearance between the upper hinge leaf and the lower door panel during articulation of the hinge to thereby inhibit the insertion of foreign matter in this region of the hinge.

Therefore, with this invention, the regions of the mating edges of adjacent panels or hinges in an overhead door which normally would have gaps or spaces providing an opportunity for the insertion of foreign objects therein and potential damage are protected. As a result, the required mating configuration, interrelation and compatibility of the adjacent panels to achieve the design parameters are maintained and opportunities for damage to and/or from foreign objects during opening and closing of the door is minimized.

BRIEF DESCRIPTION OF THE DRAWINGS

The objectives and features of the invention will become more readily apparent from the following detailed description taken in conjunction with the accompanying drawings in which.

DETAILED DESCRIPTION OF THE INVENTION

Figure 1:
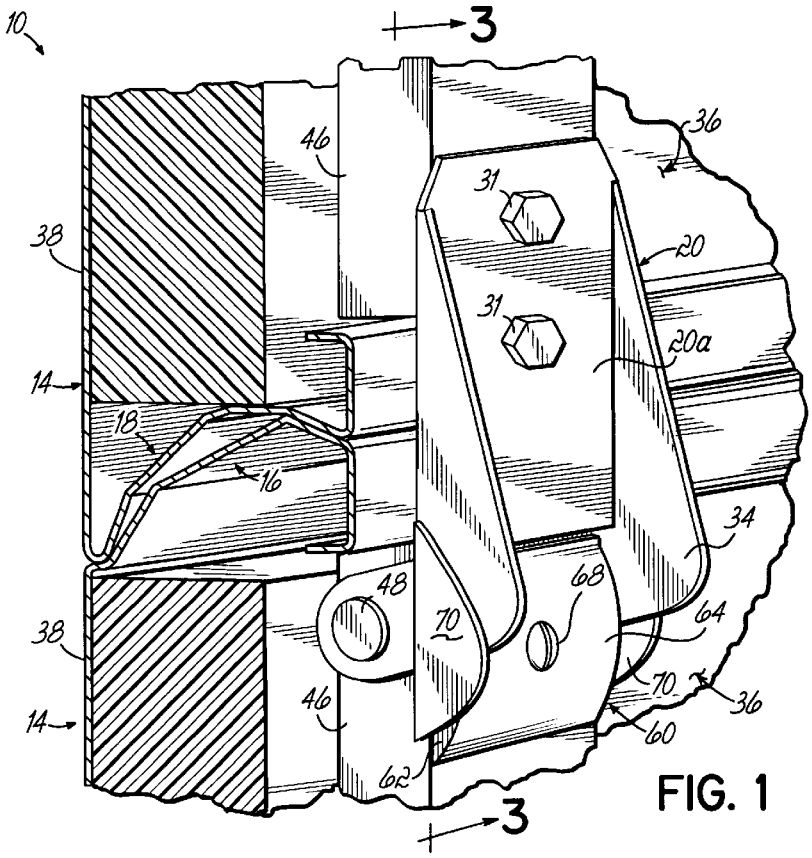
FIG. 1 is a perspective view of a pair of adjacent panels of an overhead door with a hinge assembly and hinge guard according to a first embodiment of this invention.
Figure 2:
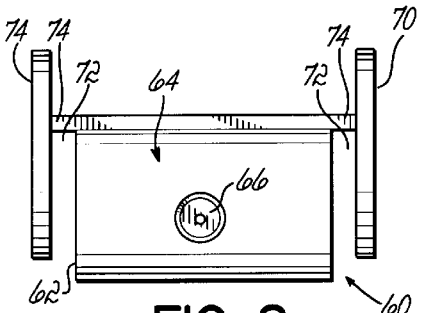
FIG. 2 is a top plan view of the hinge guard of FIG. 1.

Referring to FIG. 1, a presently preferred embodiment of a portion of an overhead door 10 according to this invention is shown in a closed generally vertical configuration covering an opening in a wall (not shown) of a garage, warehouse or the like. The door 10 includes a plurality, two of which are shown in FIG. 1, of panels 14. Each panel 14 includes upper and lower generally horizontally oriented edges 16, 18 which are configured to mate with the lower and upper edges 18, 16 respectively, of an adjacent panel 14 when the door 10 is in the closed configuration as shown in FIG. 1.

The adjacent panels 14 are pivotally connected together by a number of hinge assemblies 20. The hinges 20 proximate the lateral side ends of each panel 14 include a roller assembly 12 (FIG. 6) for coupling the door 10 to a track assembly (not shown). The roller assemblies 12 each include a roller 22 mounted for rotation on a shaft 24 contained in a roller tube 26 seated in holes 28 in upright tabs 30 of each hinge 20. The hinges 20 are mounted on the panels 14 with fasteners such as screws or bolts 31 and the roller assemblies 12 couple to the track assembly to guide the door 10 between the closed and open configurations.

Figure 3:
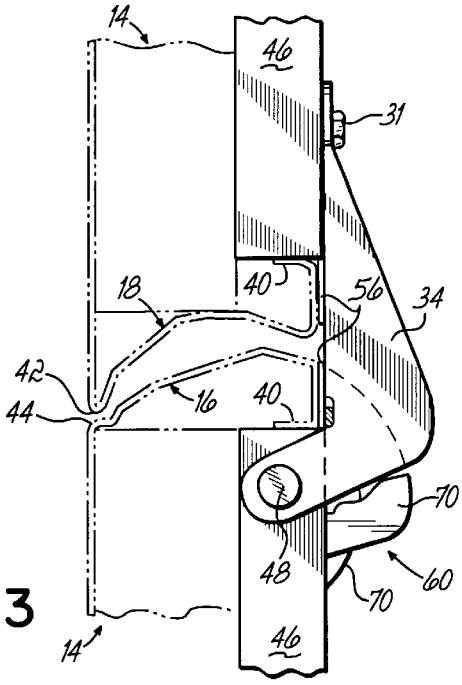
FIG. 3 is a cross-sectional view taken along line 3—3 of FIG. 1.
Figure 4:
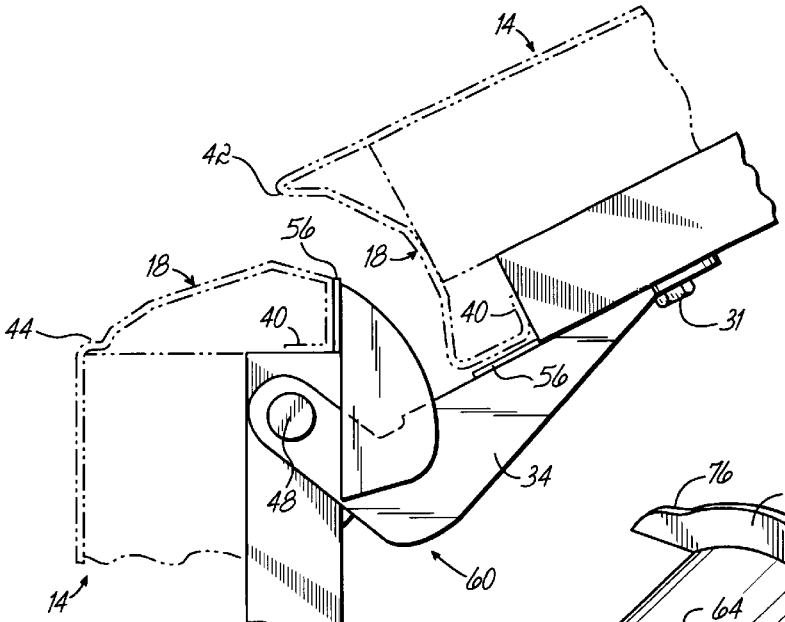
FIG. 4 is a view similar to FIG. 3 with the door panels pivoted relative to one another.

Referring to FIGS. 1, 3, and 4, the upper and lower edges 16, 18 of the panels 14 are each finished with a rail 32 joined to the respective edges 16, 18. The rail 32 includes a back face 36 which is generally parallel to a panel front face 38 and a terminal lip 40 which projects perpendicularly to the back face 36 and toward the front face 38. The lower edge 18 of each panel 14 according to a presently preferred embodiment of this invention has a generally concave configuration for mating with the upper generally convex-shaped edge 16 of an adjacent panel 14.

A rounded nose 42 is at the junction between the front face 38 of the panel 14 and the lower edge 18. At the juncture between the front face 38 and the upper edge 16 of the panel 14 is a shoulder 44 providing a landing area for the nose 42 when the door 10 is in the closed configuration as shown in FIG. 1. In the closed configuration, the nose 42 on the lower edge 18 of the panel 14 normally contacts the shoulder 44 on the upper edge 16 of the adjacent panel 14 at the front faces 38 of the panels 14 thereby providing a first contact location between the mating adjacent panels 14.

A second contact location between the adjacent upper and lower edges 16, 18 of the panels 14 according to one embodiment of this invention is proximate the back face 36 of the panels 14 and includes an obliquely angled or, more specifically, a downwardly sloping interface between the upper and lower edges 16, 18 when the door 10 is in the closed configuration. A more detailed disclosure of the panel configuration according to one embodiment of this invention is found in U.S. Pat. No. 6,006,817, assigned to the assignee of this invention and hereby incorporated by reference in its entirety. Nevertheless, this invention is readily employed on a panel design of another configuration.

Referring particularly to FIGS. 1, 3 and 4, the hinge assembly 20, according to a presently preferred embodiment of this invention, includes a first hinge leaf 20*a* which is attached to a stile 46 proximate the lower edge 18 of one panel 14. The hinge 20 includes a pair of spaced and parallel generally L-shaped arms 34 between which the stile 46 proximate the upper edge 16 of the panel 14 is positioned. A pivot member 48, such as a pivot pin is inserted through holes 50 in the arms 34 and aligned holes 52 in the stile 46. The hinge leaf 20*a* is attached to the superjacent panel 14 by bolts, screws or other mechanical fasteners 31. The fasteners 31 are shown in FIG. 1 as being arranged vertically on the hinge leaf 20*a*; however, preferably the fasteners 31 are arranged horizontally (FIG. 6) and project through holes 54 in the hinge leaf 20*a* to minimize rocking and flexure of the panels 14 during opening and closing of the door 10. Preferably, upper and lower ends of each of the stiles 46 each include a tab 56 which is juxtaposed to the back face 36 of the panel 14 (FIGS. 3–4).

As can be readily seen in FIG. 4, the pivot pin 48 provides a pivot axis for the hinge assembly 20 which is located within the profile of the panel 14 and inwardly of the back face 36 of the panel 14 and between the back face 36 and front face 38 thereof. Advantageously, positioning the pivot pin 48 and pivot axis of the hinge 20 inwardly from the back faces 36 of the panels 14 helps to minimize the spacing between the upper and lower edges 16, 18 of the adjacent panels 14 during articulation of the panels 14 while opening and closing the door 10.

Referring to FIGS. 1–4, one embodiment of a hinge guard 60 according to this invention is shown installed on the hinge assembly 20 of an overhead door 10. The hinge guard 60 includes a generally rectangular base 62 having a generally planar surface. A smoothly continuous arcuate-shaped boss 64 is formed to project upwardly from the base 62. An aperture 66 is formed through the boss 64 and is adapted to have a mechanical fastener 68 such as a screw, bolt, or the like inserted therethrough to secure the hinge guard 60 to one of the panels 14 and preferably, the stile 46 on a subjacent panel 14 and is shown in FIGS. 1 and 4.

The hinge guard 60 also includes a pair of protective flanges 70, each of which has a generally planar lower surface and a smoothly continuous contoured upper surface. Each flange 70 is spaced from an adjacent side edge of the base 62 to form a gap 72 therebetween. Likewise, each flange 70 is connected to the base 62 by a bridge 74 as clearly shown in FIG. 2. In one embodiment of this invention, the hinge guard 60 is integrally molded from polypropylene. The base 62 has a generally rectangular configuration and is approximately 1.876" in length and 1.211" in width. Each protective flange 70 is approximately 0.94" wide and has a height of approximately 0.65". The gap 72 is about 0.1" wide and is sized and configured to accommodate the movement of the associated hinge arm 34 between the base 62 and protective flange 70 during articulation of the hinge assembly 20 and movement of the door 10 to and between the open and closed positions.

Preferably, the size and configuration of the boss 64 is designed to minimize the spacing or gap between the hinge guard 60 and the lower edge of the hinge leaf 20*a* during articulation of the door 10 and adjacent panels 14. Likewise, the protective flanges 70 shield or block access to openings or gaps produced by the pivotal movement of the panels 14 and articulation of the hinge assembly 20. As such, foreign objects are inhibited from being inserted into the hinge assembly 20 and potential damage to the foreign objects, the hinge assembly 20 and/or components of door 10 is minimized.

Figure 5:
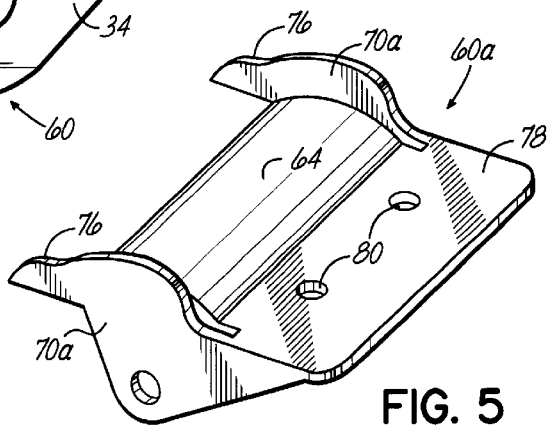
FIGS. 5 and 6 are perspective views of a second embodiment of the hinge guard and hinge guard with hinge and roller assembly, respectively.
Figure 6:
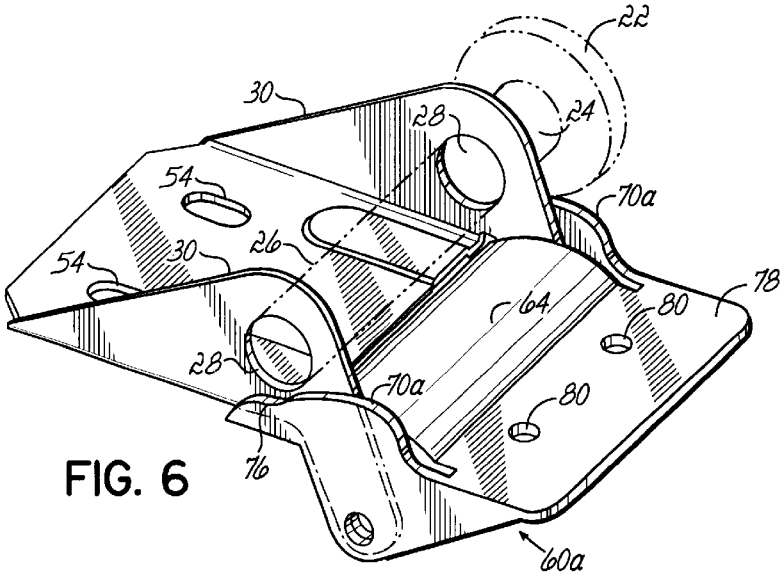

Referring to FIGS. 5–6, a second embodiment of the hinge guard 60*a* according to this invention is shown. The second embodiment of the hinge guard 60*a* is particularly designed and adapted for use on a laterally outboard hinge 20 on the panel 14 to which the roller assembly 12 is attached. As such, the protective flanges 70*a* of the hinge guard 60*a* as shown in FIGS. 5 and 6 include a step 76 to accommodate and provide clearance for the roller tube 26 seated within the tabs 30 of the hinge leaf 20*a*. Additionally, an anchor plate 78 is provided on the base 62 of the hinge guard 60*a* and a number of holes 80 are included in the anchor plate 78 through which mechanical fasteners (not shown) such as screws, bolts or rivets may be used to mount the hinge guard 60*a* to the back face 36 of the panel 14.

It should be readily appreciated that, although a pivot pin 48 is shown in FIGS. 1, 3 and 4, alternative pivot members may be included with this invention such as rivets, living hinges or other pivotally coupling members. Moreover, the hinge assembly 20 shown and described herein is a presently preferred embodiment for use with the panel design disclosed in U.S. Pat. No. 6,006,817. However, the hinge guard of this invention can be readily applied to other panel and hinge assembly designs including hinge assemblies having both an upper and lower hinge leaf with a pivot member coupling them together.

Advantageously, the hinge guard of this invention can be readily utilized as an accessory or add-on feature to an existing and/or installed overhead door system without disassembly of the overhead door 10. Alternatively, the hinge guard may be included as original equipment on a newly installed overhead door system.

It should be readily appreciated that although certain embodiments and configurations of the invention are shown and described herein, the invention is not so limited. For example, while the hinge guard is shown anchored by fasteners, other attachment mechanisms are readily available within the scope of this invention. Moreover, the hinge guard is shown in a specific configuration for compatibility with the panel design and hinge assembly shown in FIGS. 1, 3 and 4 while other configurations and designs of the invention are envisioned for implementation on panels and/or hinges of different configurations. Likewise, the hinge guard may be utilized or attached proximate to the lower edge 18 of the superjacent panel 14 alone or in combination with attachment to the upper edge 16. Additionally, the configuration, position, placement and design of the flanges and/or bosses may be modified within the scope of this invention for compatibility with panels and/or hinges which may differ from those shown in FIGS. 1, 3 and 4.

From the above disclosure of the general principles of the present invention and the preceding detailed description of at least one preferred embodiment, those skilled in the art will readily comprehend the various modifications to which this invention is susceptible. Therefore, we desire to be limited only by the scope of the following claims and equivalents thereof.

I claim:

1. A guard for a hinge on a sectional door in which adjacent panels are pivotally coupled together by the hinge, the guard comprising:

a base adapted to be mounted to a first one of the panels of the sectional door;

at least one flange connected to the base, each flange being juxtaposed to a hinge arm of the hinge when the guard is installed on the sectional door to inhibit insertion of a foreign object therein during pivotal movement of the adjacent panels and articulation of the hinge; and a boss projecting upwardly from the base when the guard is mounted to the first panel, the boss reducing a spacing between a portion of the hinge and the first panel to inhibit insertion of a foreign object therein during pivotal movement of the adjacent panels and articulation of the hinge.

2. The guard of claim 1 wherein the boss has an arcuate profile.

3. A guard for a hinge on a sectional door in which adjacent panels are pivotally coupled together by the hinge, the guard comprising:

a base adapted to be mounted to a first one of the panels of the sectional door;

at least one flange connected to the base, each flange being juxtaposed to a hinge arm of the hinge when the guard is installed on the sectional door to inhibit insertion of a foreign object therein during pivotal movement of the adjacent panels and articulation of the hinge; and a step in the flange to provide clearance for a roller tube installed on the hinge.

4. A guard for a hinge on a sectional door in which adjacent panels are pivotally coupled together by the hinge, the guard comprising:

a base adapted to be mounted to a first one of the panels of the sectional door; and at least one flange connected to the base, each flange being juxtaposed to a hinge arm of the hinge when the guard is installed on the sectional door to inhibit insertion of a foreign object therein during pivotal movement of the adjacent panels and articulation of the hinge;

wherein each flange is spaced from the base to provide a gap in which the hinge arm moves during pivotal movement of the adjacent panels and articulation of the hinge.

5. The guard of claim 4 wherein the hinge includes a pair of spaced hinge arms and the guard further comprises:

a pair of flanges each of which is positioned on an outboard side of one of the hinge arms when the guard is installed on the sectional door.

6. The guard of claim 4 further comprising:

at least one bridge connecting the flange to the base and spanning the gap.

7. The guard of claim 4 further comprising:

an anchor plate connected to the base; and a fastener adapted to be coupled to the anchor plate and the first panel to mount the guard to the sectional door.

8. The guard of claim 4 wherein each flange is adapted to be positioned generally parallel to the associated hinge arm of the hinge.

9. A guard for a hinge on a sectional door in which adjacent panels are pivotally coupled together by the hinge which includes a pair of hinge arms, the guard comprising:

a base adapted to be mounted to a first one of the panels of the sectional door;

a pair of flanges each connected to the base and being juxtaposed to an outboard side of one of the hinge arms of the hinge when the guard is installed on the sectional door to inhibit insertion of a foreign object therein during pivotal movement of the adjacent panels and articulation of the hinge;

wherein each flange is spaced from the base to provide a gap in which the hinge arm moves;

a pair of bridges each connecting one of the flanges to the base and spanning the associated gap; and a boss having an arcuate profile projecting upwardly from the first panel when the guard is mounted thereto, the boss reducing a spacing between a portion of the hinge and the first panel to inhibit insertion of a foreign object therein during pivotal movement of the adjacent panels and articulation of the hinge.

10. The guard of claim 9 wherein the flange further comprises:

a step in the flange to provide clearance for a roller tube installed on the hinge.

11. The guard of claim 9 further comprising:

an anchor plate connected to the base; and a fastener adapted to be coupled to the anchor plate and the first panel to mount the guard to the sectional door.

12. The guard of claim 9 wherein each flange is adapted to be positioned generally parallel to the associated hinge arm of the hinge.

13. A hinge assembly adapted for use on a sectional door to pivotally couple adjacent panels of the door together, the hinge assembly comprising:

a hinge leaf adapted to be secured to a first one of the adjacent panels of the door;

at least one hinge arm protecting from the hinge leaf to span a juncture between the adjacent panels when the hinge assembly is installed on the sectional door;

a pivot member adapted to pivotally couple the hinge arm to a second one of the adjacent panels;

a guard adapted to be mounted to the second panel, the guard comprising:

(a) a base; and (b) at least one flange connected to the base, the flange being juxtaposed to the hinge arm when the hinge assembly is installed on the sectional door to inhibit insertion of a foreign object therein during pivotal movement of the adjacent panels and articulation of the hinge assembly;

(c) a boss projecting upwardly from the base when the hinge assembly is mounted to the first panel, the boss reducing a spacing between a portion of the hinge assembly and the first panel to inhibit insertion of a foreign object therein during pivotal movement of the adjacent panels and articulation of the hinge assembly.

14. The hinge assembly of claim 13 wherein the boss has an arcuate profile.

15. The hinge assembly of claim 13 wherein the boss further comprises:

a step in the arcuate profile to provide clearance for a roller tube installed on the hinge assembly.

16. The hinge assembly of claim 13 wherein the hinge leaf includes a pair of spaced hinge arms and the guard further comprises:

a pair of flanges each of which is positioned on an outboard side of one of the hinge arms when the hinge assembly is installed on the sectional door.

17. The hinge assembly of claim 13 further comprising:

an anchor plate connected to the base; and a fastener adapted to be coupled to the anchor plate and the first panel to mount the guard to the sectional door.

18. A hinge assembly adapted for use on a sectional door to pivotally couple adjacent panels of the door together, the hinge assembly comprising:

a hinge leaf adapted to be secured to a first one of the adjacent panels of the door;

at least one hinge arm projecting from the hinge leaf to span a juncture between the adjacent panels when the hinge assembly is installed on the sectional door;

a pivot member adapted to pivotally couple the hinge arm to a second one of the adjacent panels;

a guard adapted to be mounted to the second panel, the guard comprising:

(a) a base; and (b) at least one flange connected to the base, the flange being juxtaposed to the hinge arm when the hinge assembly is installed on the sectional door to inhibit insertion of a foreign object therein during pivotal movement of the adjacent panels and articulation of the hinge assembly, wherein each flange is spaced from the base to provide a gap in which the hinge arm moves during pivotal movement of the adjacent panels and articulation of the hinge assembly.

19. The hinge assembly of claim 18 further comprising:

at least one bridge connecting the flange to the base and spanning the gap.

20. A hinge assembly adapted for use on a sectional door to pivotally couple adjacent panels of the door together, the hinge assembly comprising:

a hinge leaf adapted to be secured to a first one of the adjacent panels of the door;

a pair of spaced hinge arms each projecting from the hinge leaf to span a juncture between the adjacent panels when the hinge assembly is installed on the door;

a pivot member adapted to pivotally couple at least one of the hinge arms to a second one of the adjacent panels;

a guard adapted to be mounted to the second panel, the guard comprising:

(a) a base;

(b) a pair of flanges each connected to the base and being juxtaposed to an outboard side of one of the hinge arms of the hinge assembly when the guard is installed on the door to inhibit insertion of a foreign object therein during pivotal movement of the adjacent panels and articulation of the hinge assembly;

wherein each flange is spaced from the base to provide a gap in which one of the hinge arms moves;

(c) a pair of bridges each connecting one of the flanges to the base and spanning the associated gap; and (d) a boss having an arcuate profile projecting upwardly from the first panel when the guard is mounted thereto, the boss reducing a spacing between a portion of the hinge and the first panel to inhibit insertion of a foreign object therein during pivotal movement of the adjacent panels and articulation of the hinge.

21. The hinge assembly of claim 20 wherein the flange further comprises:

a step in the flange to provide clearance for a roller tube installed on the hinge assembly.

22. The hinge assembly of claim 20 further comprising:

an anchor plate connected to the base; and a fastener adapted to be coupled to the anchor plate and the second panel to mount the guard to the door.

23. The hinge assembly of claim 20 wherein the hinge leaf further comprises:

a hinge leaf base adapted to be secured to the first one of the panels of the door, each hinge arm projecting from the hinge leaf base;

wherein each flange is positioned generally parallel to the associated hinge arm of the hinge when the hinge assembly is installed on the door.

24. An overhead door capable of being selectively moved between a generally horizontal open configuration and a generally vertical closed configuration covering an opening, the door comprising:

a plurality of serially connected panels each having a front face and a back face:

a stile on the back face of each panel extending between upper and lower edges thereof;

a track assembly mounted proximate the opening, the track assembly including a generally vertical section, a generally horizontal section and a transition section joining the horizontal and vertical sections together;

a plurality of rollers mounted on the panels and coupled to the track assembly to guide the door between the closed and open;

a plurality of hinge assemblies proximate the back faces and joining adjacent panels, wherein each hinge assembly further comprises:

(a) a hinge leaf secured to a first one of the adjacent panels of the door;

(b) at least one hinge arm projecting from the hinge leaf to span a juncture between the adjacent panels;

(c) a pivot member pivotally coupling the hinge arm to a second one of the adjacent panels;

(d) a guard having a base mounted to the second panel; and (e) at least one flange connected to the base, the flange being juxtaposed to the hinge arm to inhibit insertion of a foreign object therein during pivotal movement of the adjacent panels and articulation of the hinge assembly;

wherein the base is attached to the stile on the second panel and the hinge leaf is secured to the stile on the first panel;

wherein the pivot member is a pin extending through the hinge arm and the stile on the second panel.

25. The door of claim 24 wherein each hinge assembly includes a pair of spaced hinge arms and each guard further comprises:

a pair of flanges each of which is positioned on an outboard side of one of the hinge arms.

26. The door of claim 24 further comprising:

an anchor plate connected to the base; and a fastener securing the anchor plate to the second panel to mount the guard to the door.

27. An overhead door capable of being selectively moved between a generally horizontal open configuration and a generally vertical closed configuration covering an opening, the door comprising:

a plurality of serially connected panels each having a front face and a back face;

a track assembly mounted proximate the opening, the track assembly including a generally vertical section, a generally horizontal section and a transition section joining the horizontal and vertical sections together;

a plurality of rollers mounted on the panels and coupled to the track assembly to guide the door between the closed and open;

a plurality of hinge assemblies proximate the back faces and joining adjacent panels, wherein each hinge assembly further comprises:

(a) a hinge leaf secured to a first one of the adjacent panels of the door;

(b) at least one hinge arm protecting from the hinge leaf to span a juncture between the adjacent panels;

(c) a pivot member pivotally coupling the hinge arm to a second one of the adjacent panels;

(d) a guard having a base mounted to the second panel; and (e) at least one flange connected to the base, the flange being juxtaposed to the hinge arm to inhibit insertion of a foreign object therein during pivotal movement of the adjacent panels and articulation of the hinge assembly;

a boss projecting upwardly from the second panel and reducing a spacing between a portion of the hinge assembly and the second panel to inhibit insertion of a foreign object therein during pivotal movement of the adjacent panels and articulation of the hinge assembly.

28. The door of claim 27 wherein the boss has an arcuate profile.

29. An overhead door capable of being selectively moved between a generally horizontal open configuration and a generally vertical closed configuration covering an opening, the door comprising:

a plurality of serially connected panels each having a front face and a back face;

a track assembly mounted proximate the opening, the track assembly including a generally vertical section, a generally horizontal section and a transition section joining the horizontal and vertical sections together;

a plurality of rollers mounted on the panels and coupled to the track assembly to guide the door between the closed and open;

a plurality of hinge assemblies proximate the back faces and joining adjacent panels, wherein each hinge assembly further comprises:

(a) a hinge leaf secured to a first one of the adjacent panels of the door;

(b) at least one hinge arm projecting from the hinge leaf to span a juncture between the adjacent panels;

(c) a pivot member pivotally coupling the hinge arm to a second one of the adjacent panels;

(d) a guard having a base mounted to the second panel; and (e) at least one flange connected to the base, the flange being juxtaposed to the hinge arm to inhibit insertion of a foreign object therein during pivotal movement of the adjacent panels and articulation of the hinge assembly;

wherein selected hinge assemblies have a roller tube supporting one of the rollers and the flange associated with each of the selected hinge assemblies further includes a step in the flange to provide clearance for the roller tube installed on the hinge assembly.

30. An overhead door capable of being selectively moved between a generally horizontal open configuration and a generally vertical closed configuration covering an opening, the door comprising:

a plurality of serially connected panels each having a front face and a back face;

a track assembly mounted proximate the opening, the track assembly, including a generally vertical section, a generally horizontal section and a transition section joining the horizontal and vertical sections together;

a plurality of rollers mounted on the panels and coupled to the track assembly to guide the door between the closed and open;

a plurality of hinge assemblies proximate the back faces and joining adjacent panels, wherein each hinge assembly further comprises:

(a) a hinge leaf secured to a first one of the adjacent panels of the door;

(b) at least one hinge arm projecting from the hinge leaf to span a juncture between the adjacent panels;

(c) a pivot member pivotally coupling the hinge arm to a second one of the adjacent panels;

(d) a guard having a base mounted to the second panel; and (e) at least one flange connected to the base, the flange being juxtaposed to the hinge arm to inhibit insertion of a foreign object therein during pivotal movement of the adjacent panels and articulation of the hinge assembly;

wherein each flange is spaced from the base to provide a gap in which the hinge arm moves during pivotal movement of the adjacent panels and articulation of the hinge assembly.

31. The door of claim 30 wherein each guard further comprises:

a bridge connecting the flange to the base and spanning the gap.

32. The door of claim 30, wherein each hinge leaf further comprises:

a hinge leaf base mounted to the first one of the panels of the door, each hinge arm projecting from the hinge leaf base.

33. The door of claim 30 wherein each hinge leaf further comprises:

a hinge leaf base mounted to the first one of the panels of the door, each hinge arm projecting from the hinge leaf base;

wherein each flange is positioned generally parallel to the associated hinge arm.

34. A method of retrofitting an overhead door having a plurality of panels each pivotally coupled to an adjacent panel by at least one hinge assembly mounted to a first panel and having a hinge arm spanning the juncture between the first panel and an adjacent second panel, the method comprising the steps of:

positioning a guard which includes a boss on the second panel;

mounting a base of the guard to the second panel of the door;

juxtaposing a flange connected to the base to the hinge arm to inhibit insertion of a foreign object therein during pivotal movement of the adjacent panels and articulation of the hinge assembly; and positioning the boss on the second panel and relative to the hinge assembly to inhibit insertion of a foreign object therein during pivotal movement of the adjacent panels and articulation of the hinge assembly.

35. The method of claim 34 wherein the juxtaposing further comprises positioning the flange on an outboard side of the hinge arm.

36. The method of claim 34 wherein the hinge assembly includes a roller tube for mounting a roller to the door, the method further comprising:

positioning a step in the flange relative to the roller tube to provide clearance for the roller tube during articulation of the hinge assembly.

37. A method of retrofitting an overhead door having a plurality of panels each pivotally coupled to an adjacent panel by at least one hinge assembly mounted to a first panel and having a hinge arm spanning the juncture between the first panel and an adjacent second panel, the method comprising the steps of:

positioning a guard on the second panel;

mounting a base of the guard to the second panel of the door;

juxtaposing a flange connected to the base to the hinge arm to inhibit insertion of a foreign object therein during pivotal movement of the adjacent panels and articulation of the hinge assembly, wherein the flange is spaced from the base by a gap and connected to the base by a bridge spanning the gap; and positioning the hinge arm within the gap for movement therein during articulation of the hinge assembly.

38. A hinge assembly adapted for use on a sectional door to pivotally couple adjacent panels of the door together, the hinge assembly comprising:

a hinge leaf adapted to be secured to a first one of the adjacent panels of the door;

at least one hinge arm projecting from the hinge leaf to span a juncture between the adjacent panels when the hinge assembly is installed on the sectional door;

a pivot member adapted to pivotally couple the hinge arm to a second one of the adjacent panels;

a guard adapted to be mounted to the second panel, the guard comprising:

(a) a base; and (b) at least one flange connected to the base, the flange being juxtaposed to the hinge arm when the hinge assembly is installed on the sectional door to inhibit insertion of a foreign object therein during pivotal movement of the adjacent panels and articulation of the hinge assembly;

wherein each flange is positioned generally parallel to the associated hinge arm of the hinge when the hinge assembly is installed on the door.

39. The hinge assembly of claim 38 wherein the hinge leaf further comprises:

a hinge leaf base adapted to be secured to the first one of the panels of the door, each hinge arm projecting from the hinge leaf base.

40. An overhead door capable of being selectively moved between a generally horizontal open configuration and a generally vertical closed configuration covering an opening, the door comprising:

a plurality of serially connected panels each having a front face and a back face;

a track assembly mounted proximate the opening, the track assembly including a generally vertical section, a generally horizontal section and a transition section joining the horizontal and vertical sections together;

a plurality of rollers mounted on the panels and coupled to the track assembly to guide the door between the closed and open;

a plurality of hinge assemblies proximate the back faces and joining adjacent panels, wherein each hinge assembly further comprises:

(a) a hinge leaf secured to a first one of the adjacent panels of the door;

(b) at least one hinge arm projecting from the hinge leaf to span a juncture between the adjacent panels;

(c) a pivot member pivotally coupling the hinge arm to a second one of the adjacent panels;

(d) a guard having a base mounted to the second panel; and (e) at least one flange connected to the base, the flange being juxtaposed to the hinge arm to inhibit insertion of a foreign object therein during pivotal movement of the adjacent panels and articulation of the hinge assembly;

wherein each flange is positioned generally parallel to the associated hinge arm.

* * * * *

UNITED STATES PATENT AND TRADEMARK OFFICE

CERTIFICATE OF CORRECTION

PATENT NO. : 6,698,492 B2
DATED : March 2, 2004
INVENTOR(S) : Richard J. Lewis, Jr.

It is certified that error appears in the above-identified patent and that said Letters Patent is hereby corrected as shown below:

Column 7,
Line 29, “arm protecting from” should read -- arm projecting from --.

Column 9,
Line 6, “face:” should read -- face; --.
Line 64, “arm protecting from” should read -- arm projecting from --.

Signed and Sealed this

Twenty-second Day of June, 2004

JON W. DUDAS
*Acting Director of the United States Patent and Trademark Office*